United States Patent [19]

Deuchar et al.

[11] 4,059,863

[45] Nov. 29, 1977

[54] COMBUSTION ENGINE POWERED FLOOR BUFFER

[76] Inventors: Robert C. Deuchar, 3401 Hoover St., Redwood City, Calif. 94063; Gene J. Waitzman, 1055 Avondale St., San Jose, Calif. 95129

[21] Appl. No.: 575,343

[22] Filed: May 7, 1975

[51] Int. Cl.[2] ..... A47L 11/162

[52] U.S. Cl. ..... 15/98; 51/177

[58] Field of Search ..... 15/49 R, 49 C, 50 R, 15/50 RB, 50 C, 98, 99, 51, 52; 56/17.5, 255; 180/54 A; 51/174–177

[56] References Cited

U.S. PATENT DOCUMENTS

| | | | |
|---|---|---|---|
| 2,555,822 | 6/1951 | Smith | 15/50 R |
| 3,098,329 | 7/1963 | Doran | 51/177 |
| 3,493,088 | 2/1970 | Hoff | 56/17.5 X |
| 3,921,244 | 11/1975 | Warren et al. | 75/98 |

*Primary Examiner*—Edward L. Roberts
*Attorney, Agent, or Firm*—Lowhurst & Aine

[57] ABSTRACT

The floor buffer includes an aluminum chassis to which the various operative elements of the floor buffer are affixed. More particularly, a buffer pad driver is journaled to the front end of the chassis and a propane tank is carried from the aft end of the chassis to which end the steering handle is affixed. An air cooled internal combustion engine is mounted to the chassis intermediate the pad driver and the fuel tank. The air cooled engine is mounted in heat exchanging relation with the chassis so that the chassis serves as a substantial heat sink for conduction cooling of the engine, in use.

10 Claims, 4 Drawing Figures

COMBUSTION ENGINE POWERED FLOOR BUFFER

BACKGROUND OF THE INVENTION

The present invention relates in general to floor buffers and more particularly to an improved floor buffer of the type powered by an internal combustion engine.

DESCRIPTION OF THE PRIOR ART

Heretofore, floor buffers have been powered by internal combustion engines. In these prior buffers, the chassis was fabricated from welded steel angle iron to form a frame structure to which the various operative elements were affixed as by bolts. The steel frame chassis supported a journaled pad driver at the forward end for driving the buffer pad. The pad driver was coupled via a belt drive to the output shaft of an air cooled propane engine bolted to the midsection of the frame chassis. A propane fuel tank was carried at the aft end of the frame structure. A steering handle was affixed to the aft end of the frame for steering the buffer, in use.

One problem encountered with this prior art buffer was that the air cooled engine had rather limited life, such as three months of use. We have discovered that the reason for limited engine life was because of insufficient air cooling of the engine when the buffer was operated at idling or less than full speed.

SUMMARY OF THE PRESENT INVENTION

The principal object of the present invention is the provision of an improved combustion engine powered floor buffer.

In one feature of the present invention, the floor buffer chassis serves as a heat sink for the air cooled internal combustion engine which is coupled to the chassis in heat exchanging relation therewith for cooling of the engine, in use.

In another feature of the present invention, the buffer chassis includes a substantial heat sinking portion coupled in heat exchanging relation with the air cooled internal combustion engine, said heat sinking portion being made of a material having greater thermal conductivity than steel, such as aluminum, for conduction cooling of the combustion engine to the chassis and thence to the surrounds of the chassis, in use.

Other features and advantages of the present invention will become apparent upon a perusal of the following specification taken in connection with the accompanying drawings wherein:

DESCRIPTION OF THE PREFERRED EMBODIMENTS

Figure 1:
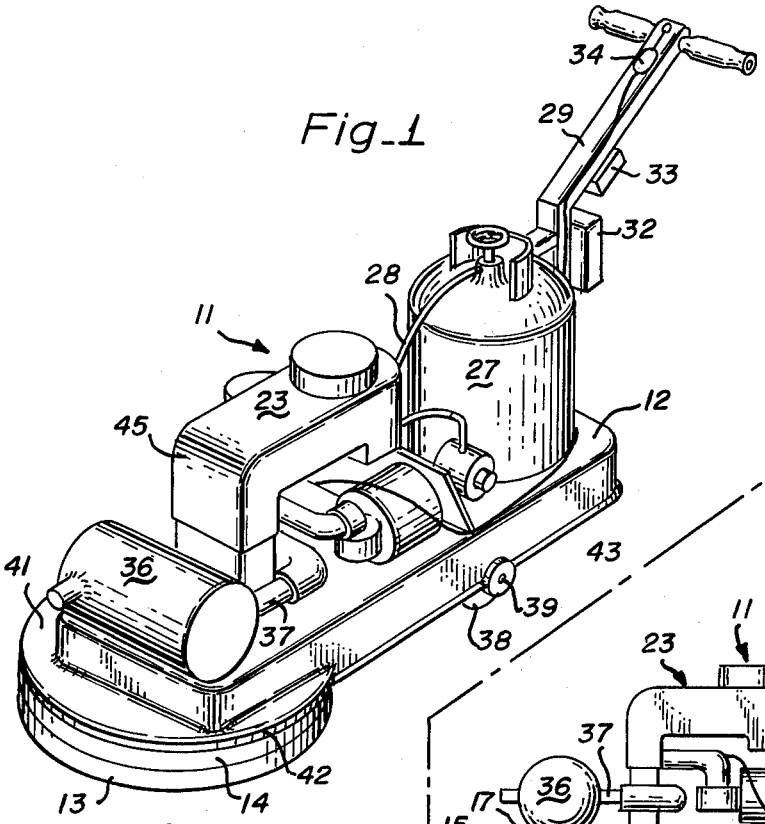
FIG. 1 is a perspective view of the floor buffer incorporating features of the present invention.
Figure 2:
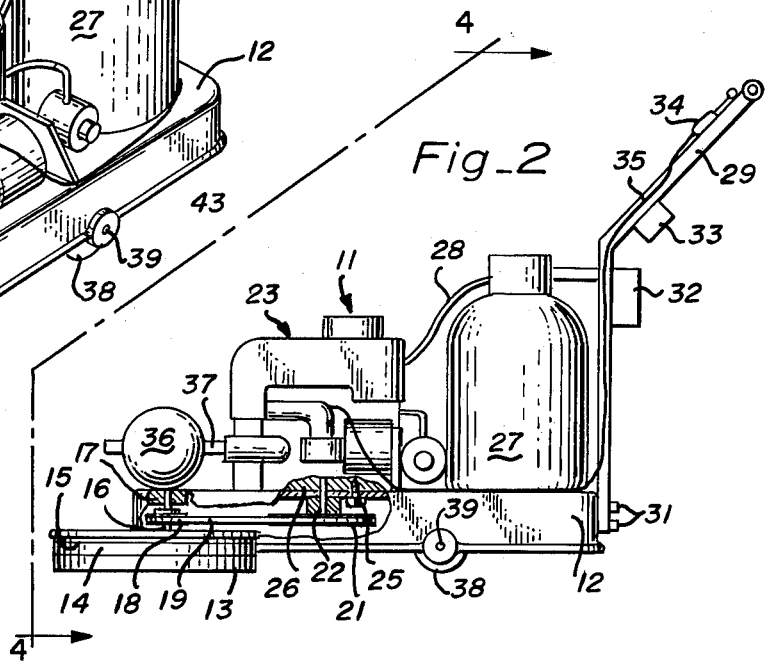
FIG. 2 is a side elevational view, partly cut away, of the structure of FIG. 1.
Figure 3:
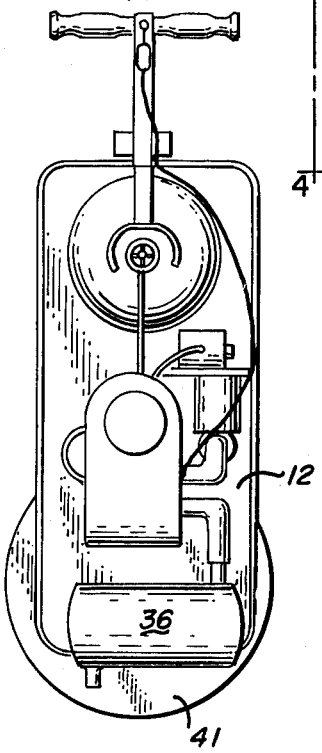
FIG. 3 is a plan view of the buffer of FIG. 1.
Figure 4:
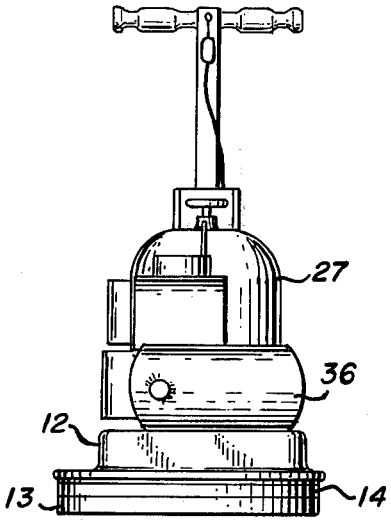
FIG. 4 is a front end view of the structure of FIG. 2 taken along line 4—4 in the direction of the arrows.

Referring now to FIGS. 1–4 there is shown the floor buffer 11 incorporating features of the present invention. The floor buffer 11 includes an elongated metallic chassis 12 for supporting the various operative elements of the buffer 11. More particularly, a circular floor buffer pad 13, of conventional material, is frictionally coupled to a conventional circular driver pad 14. Driver pad 14 is coupled to a circular backing plate 15 of conventional design, which in turn is carried from an axle 16 rotationally supported from the chassis 12 via bearing assembly 17. A pulley 18 is carried from the axle 16. The pulley 18 is driven via a V-belt 19 extending around a second pulley 21 carried from the output end of a centrifugal clutch 22 key coupled to the output shaft of an air cooled internal combustion engine 23. In a preferred embodiment, the engine 23 is a vertical crank shaft type, four cycle aluminum engine. The engine 23 is mounted in heat exchanging relation with the chassis 12 via three cup screws 25 passing through a bolt circle in the chassis 12 into a eight inch diameter bolt circle surrounding a mounting pad portion 26 of the aluminum block of the engine 23. A liquified propane fuel tank 27 is mounted proximate the aft end of the chassis 12. Propane fuel is fed from the fuel tank 27 to the engine 23 via a conventional propane fuel line 28.

A handle 29 is fixedly secured to the aft end of the chassis 12 via conventional means, such as bolts 31. A battery 32 for starting the engine 23 is carried from the handle 29. A starter switch 33 is also carried from the handle 29 for controlling the current from the battery 32 to the starter of the engine 23. A throttle 34 is secured to the handle and an actuating throttle linkage passes through an armored cable 35 to the engine 23 for controlling the throttle setting of the engine. An exhaust muffler 36 is carried at the forward end of the chassis 12 for muffling the exhaust gases of the engine 23 as fed to the muffler 36 via engine exhaust tubulation 37.

A pair of wheels 38 are fixedly secured on an axle 39 passing laterally of the chassis 12 in the region intermediate the position of the engine 23 and the fuel tank 27. The wheels 38 engage the floor for supporting the weight of the buffer 11. The chassis 12 includes a semicircular radially directed flange portion 41 disposed at the front end of the chassis overlying the buffer pad 13 and drive pad 14 so as to cover the rotating pads. In addition, a rubber bumper 42 is provided at the lip of the flange 41 to prevent nicking or otherwise abraiding walls and furniture.

In a typical example, the chassis 12 is fabricated as a one-piece aluminum casting having a plate-like upper structure to which the various elements including the muffler 36, engine 23 and fuel tank 27 are mounted and having a downturned flange portion 43 for added strength. The casting 12 is relatively thick as of 0.50 inch and is relatively massive having weight of approximately 40 pounds.

The engine 23, in a typical example, is a seven horsepower Tecumseh model VH 70 gasoline engine converted for propane use. The engine is air cooled and a shroud 45 serves to direct the air over the cylinder heads for cooling of the engine, in use. The drive pulleys 21 and 18 are proportioned in diameter so that when the engine is running at rated power the buffer pad 13 is rotated at 1400 rpm.

In operation, when the engine 23 is operating at rated power, the air cooling fan is sufficient for proper cooling of the engine. However, when the engine 23 is set for idling or at lower than rated power, the air cooling is inadequate and the thermally conductive chassis 12, which is employed in heat exchanging relation with the engine, serves as a massive heat sink for the engine. Heat flowing into the chassis 12 from the engine 23 is carried away from the chassis to the surrounds by radiation and convection.

The advantage of the heat sinking chassis 12 is that it prevents overheating of the engine especially under idling conditions and greatly prolongs the operating life of the engine 23.

The centrifugal clutch 22 facilitates engine starting as it serves to decouple the engine 23 from the buffer pad 13 when the engine has low or zero speed of rotation. on the other hand, the clutch 22 permits slippage between the crankshaft of the engine and the buffer pad when the buffer pad is suddenly stopped, as by catching on a snag, thus decoupling the buffer chassis from high rotational torque otherwise transmitted through the pad drive mechanism to the chassis 12.

What is claimed is:

1. In a combustion engine powered floor buffer:

floor buffer chassis means for supportively receiving the operative elements of the floor buffer;

buffer pad driver means for rotationally driving a buffer pad to be coupled thereto, said buffer pad driver means being rotationally coupled to said floor buffer chassis means;

an air cooled internal combustion engine means for supplying the rotational driving power to said buffer pad driver means;

means for coupling said combustion engine means in heat exchanging relation with said chassis means for heat sinking said engine so as to provide substantial thermal conduction cooling of said combustion engine means to said chassis means and thence to the surrounds of said chassis means, in use; and wherein said buffer pad driver means includes, pad driver shaft means rotationally carried from said chassis means, power transmission means for transmitting the rotational output power derived from the output shaft of said engine means to the buffer pad, said power transmission means including first and second pulley means coupled to the output shaft of said engine means and to said pad driver shaft means respectively, and drive belt means interconnecting said first and second pulley means, and wherein said first and second pulley means and said drive belt means are disposed underneath said chassis means on the opposite side of said chassis means from said engine means.

2. In a combustion engine powered floor buffer:

an elongated aluminum chassis for supportively receiving operative elements of the floor buffer, said chassis having a flat engine mounting pad portion to receive a flat mounting pad portion of the engine which is to be mounted to said chassis in use;

an air cooled internal combustion engine having a maximum rated power in excess of four horsepower for supplying the rotational driving power to the buffer pad for driving the buffer pad, in use, said engine having an aluminum body, air cooling shroud means for ducting cooling air over said engine, in use, for air cooling same, said aluminum engine body having a flat mounting pad portion formed thereon for conduction cooling of said engine in use, said flat mounting pad portion of said engine being mounted to said flat mounting pad portion of said chassis in heat exchanging relation therewith for providing substantial thermal conduction cooling of said engine to said chassis and thence to the surrounds of said chassis in use;

said engine having a vertically directed output shaft depending from said engine and passing through an aperture in said chassis;

a first drive pulley coupled to said engine output shaft on the opposite side of said chassis from said engine;

a pad driver shaft vertically dependent from said chassis forward of said engine mounting pad, a bearing assembly rotationally supporting said pad driver shaft from said chassis, a second drive pulley coupled to said pad driver shaft;

a flexible driving means for interconnecting said first and second pulleys for transmitting rotational pad driving power from said engine to said buffer pad driver shaft; and pad driver means for coupling a buffer pad to said pad driver shaft for rotationally driving the buffer pad from said pad driver shaft.

3. The apparatus of claim 2 wherein said elongated aluminum chassis has a weight in excess of twenty pounds to provide substantial heat sinking of said engine in use.

4. In a combustion engine powered floor buffer:

floor buffer chassis means for supportively receiving and supporting the operative elements of the floor buffer, said chassis means including a substantial heat sinking portion thereof made of a material having greater thermal conductivity than steel, said heat sinking portion of said chassis means having an engine mounting pad portion to receive a corresponding mounting pad portion of the engine which is to be mounted to said chassis in use;

buffer pad driver means for rotationally driving a buffer pad to be coupled thereto, said buffer pad driver means being rotationally coupled to said floor buffer chassis means;

an air cooled internal combustion engine means having a maximum rated power in excess of four horsepower for supplying the rotational driving power to said buffer pad driver means, said engine means having a mounting pad portion formed thereon for conduction cooling of said engine in use; and means for coupling said mounting pad portion of said chassis means in heat exchanging relation with said mounting pad portion of said engine means for heat sinking said engine means to said chassis means so as to provide substantial thermal conduction cooling of said combustion engine means to said chassis means and thence to the surrounds of said chassis means, in use.

5. The apparatus of claim 4 wherein said chassis means includes an elongated plate portion of aluminum having said buffer pad driver means rotationally coupled to said plate portion proximate one end thereof, fuel tank means coupled to said plate portion of said chassis means proximate the other end thereof, said internal combustion means being coupled to said plate portion in heat exchanging relation therewith in a position intermediate the positions of said fuel tank means and said pad driver means.

6. The apparatus of claim 4 wherein said air cooled internal combustion engine means has an aluminum body including said mounting pad portion formed as a portion thereof.

7. The apparatus of claim 6 wherein said heat sinking portion of said chassis means is made of aluminum.

8. The apparatus of claim 7 wherein said engine means has a generally vertically directed output shaft extending downwardly through an opening in said chassis means, said pad driver means including power transmission means mounted underneath said chassis means for transmitting the output power of said engine means to the driven buffer pad.

9. The apparatus of claim 8 wherein said power transmission means includes pulley and drive belt means interconnecting said engine output shaft and the buffer pad for driving the buffer pad.

10. The apparatus of claim 4 wherein said heat sinking portion of said chassis means is made of aluminum and has a weight in excess of twenty pounds to provide substantial heat sinking of said engine in use.

* * * * *